US012139928B1

(12) United States Patent
Berio et al.

(10) Patent No.: US 12,139,928 B1
(45) Date of Patent: Nov. 12, 2024

(54) FENCE POST CAP ASSEMBLY WITH HANGER AND FENCE SYSTEM INCORPORATING THE SAME

(71) Applicant: The Fence Pot Inc., St. James, NY (US)

(72) Inventors: Christian Berio, West Islip, NY (US); Antonio Fischietti, West Islip, NY (US)

(73) Assignee: The Fence Pot Inc., St. James, NY (US)

( * ) Notice: Subject to any disclaimer, the term of this patent is extended or adjusted under 35 U.S.C. 154(b) by 0 days.

(21) Appl. No.: 18/423,132

(22) Filed: Jan. 25, 2024

(51) Int. Cl.
*E04H 17/20* (2006.01)
*A47G 7/04* (2006.01)
*E04H 17/00* (2006.01)

(52) U.S. Cl.
CPC ..... *E04H 17/006* (2021.01); *A47G 7/045* (2013.01)

(58) Field of Classification Search
CPC ..... E04H 17/006; A47G 7/045
See application file for complete search history.

(56) References Cited

U.S. PATENT DOCUMENTS 1,292,137 A * 1/1919 Strout ..... G09F 7/18 340/321
4,722,514 A 2/1988 Pettit
4,896,456 A 1/1990 Grant
5,332,196 A * 7/1994 Wright ..... E04H 17/006 256/DIG. 5
6,722,637 B2 4/2004 Burkart et al.
7,461,833 B1 * 12/2008 Gibbs ..... E04H 17/003 256/22
7,845,604 B2 12/2010 Connor, Jr.
8,104,734 B2 1/2012 Stover
2008/0250749 A1 * 10/2008 Weldon ..... E04H 17/006 52/718.01
2010/0243975 A1 * 9/2010 Stover ..... E04H 17/24 256/59
2015/0108419 A1 * 4/2015 Ostheller ..... E04H 17/06 256/33
2017/0191609 A1 * 7/2017 Zoutman ..... A01K 39/01
2018/0231180 A1 * 8/2018 Zoutman ..... A01G 9/12
2019/0085591 A1 * 3/2019 Zhu ..... E04H 17/006
2019/0285104 A1 * 9/2019 Blank ..... F16M 13/02

* cited by examiner

*Primary Examiner* — Joshua T Kennedy
(74) *Attorney, Agent, or Firm* — Carter, DeLuca & Farrell LLP

(57) ABSTRACT

A fence post cap assembly includes a cap body, a hanger, and a stabilization body. The hanger has a support end portion extending through the cap body and at least one free end portion disposed above the cap body, extending in a first direction, and configured to receive a hanging device. The stabilization body is engaged to the support end portion of the hanger below the cap body and includes first and second ends extending in opposite directions. The fence post cap assembly is configured to engage a free end of a fence post with the stabilization body disposed within the fence post whereby the first and second ends of the stabilization body are configured to contact walls in the interior of the fence post to stabilize the hanger.

14 Claims, 6 Drawing Sheets

FENCE POST CAP ASSEMBLY WITH HANGER AND FENCE SYSTEM INCORPORATING THE SAME

BACKGROUND

Technical Field

The present disclosure relates to the hanging of hanging devices such as flowerpots, plants, lighting, decorations, and the like. More particularly, the present disclosure relates to a fence post cap assembly with a hanger (e.g., for hanging a hanging devices) and a fence post system incorporating the same.

Background of Related Art

Fences are often used to define land boundaries between neighbors, establish privacy from adjoining land, and/or fully or partially enclose specific areas, e.g., yards, parking lots, playgrounds, etc. Fences are typically constructed by setting a plurality of spaced-apart fence posts in the ground and mounting a fence panel between each pair of adjacent fence posts. Historically, the fence posts were made from solid wood beams and the fence panels were made from a plurality of wood slats mounted side-by-side on one or more wood support rails.

More recently, fence manufacturers have turned to metals, composite materials, and/or plastics (e.g., PVC or vinyl), due to their strength, durability, and maintenance-free attributes. Such fences are constructed similar to their wood counterparts, that is, by setting a plurality of spaced-apart fence posts in the ground and mounting a fence panel between each pair of adjacent fence posts.

SUMMARY

As used herein, terms including "generally," "about," "substantially," and the like are meant to encompass variations, e.g., manufacturing tolerances, material tolerances, use and environmental tolerances, measurement variations, design variations, and/or other variations, up to and including plus or minus 10 percent. Further, to the extent consistent, any or all of the aspects detailed herein may be used in conjunction with any or all of the other aspects detailed herein.

Provided in accordance with the present disclosure is a fence post cap assembly including a cap body, a hanger, and a stabilization body. The cap body includes a head and a neck extending from the head. The neck defines a hollow interior and the head defines an aperture in communication with the hollow interior of the neck. The hanger has a support end portion and at least one free end portion. The support end portion defines a longitudinal axis and extends through the aperture of the head of the cap body. The free end portion of the hanger is disposed above the cap body and extends from the longitudinal axis in a first direction. The free end portion of the hanger is configured to receive a hanging device for hanging the hanging device from the hanger at a position offset from the longitudinal axis in the first direction. The stabilization body is engaged to the support end portion of the hanger below the cap body. The stabilization body includes a first end extending from the longitudinal axis in the first direction and second end extending from the longitudinal axis in a second direction opposite the first direction. The fence post cap assembly is configured to engage a free end of a fence post with the stabilization body disposed within an interior of the fence post and the hollow interior of the neck of the cap body receiving the free end of the fence post. The first and second ends of the stabilization body are configured to contact walls in the interior of the fence post to stabilize the hanger.

In an aspect of the present disclosure, the at least one free end portion of the hanger includes a hook disposed at a free end thereof. The hook is configured to receive the hanging device.

In another aspect of the present disclosure, the at least one free end portion of the hanger defines an arcuate configuration extending from the longitudinal axis in the first direction.

In still another aspect of the present disclosure, the stabilization body includes a central support and first and second arms extending from the central support. The first and second arms define the first and second ends, respectively.

In still yet another aspect of the present disclosure, the first and second ends of the stabilization body are longitudinally offset along the longitudinal axis. In such aspects, the first end may be positioned closer to the cap body along the longitudinal axis compared to the second end.

In another aspect of the present disclosure, at least one retention nut is configured to secure the hanger to the cap body and/or the stabilization body. In such aspects, first and second retention nuts may secure the hanger, the cap body, and the stabilization body therebetween.

In still another aspect of the present disclosure, the hanger is a metal rod.

In yet another aspect of the present disclosure, the hollow interior of the neck of the cap body defines a square cross-sectional configuration. The square cross-sectional configuration may be configured to receive a standardized fence post and, thus may define a square cross-sectional configuration of, for example, 4×4 inches or, in other aspects, 5×5 inches.

A fence system provided in accordance with the present disclosure includes the fence post cap assembly according to any of the aspects detailed above or otherwise herein and a fence including the fence post and at least one fence panel connected to the fence post. In such aspects, the first and second directions may be substantially coplanar relative to the at least one fence panel. Alternatively, the first and second directions may be substantially perpendicular relative to the at least one fence panel.

In an aspect of the present disclosure, the at least one fence panel includes first and second fence panels connected to the fence post and extending from the fence post in different directions.

BRIEF DESCRIPTION OF THE DRAWINGS

The above and other aspects and features of the present disclosure will become more apparent in view of the following detailed description when taken in conjunction with the accompanying drawings wherein like reference numerals identify similar or identical elements.

DETAILED DESCRIPTION

Figure 1:
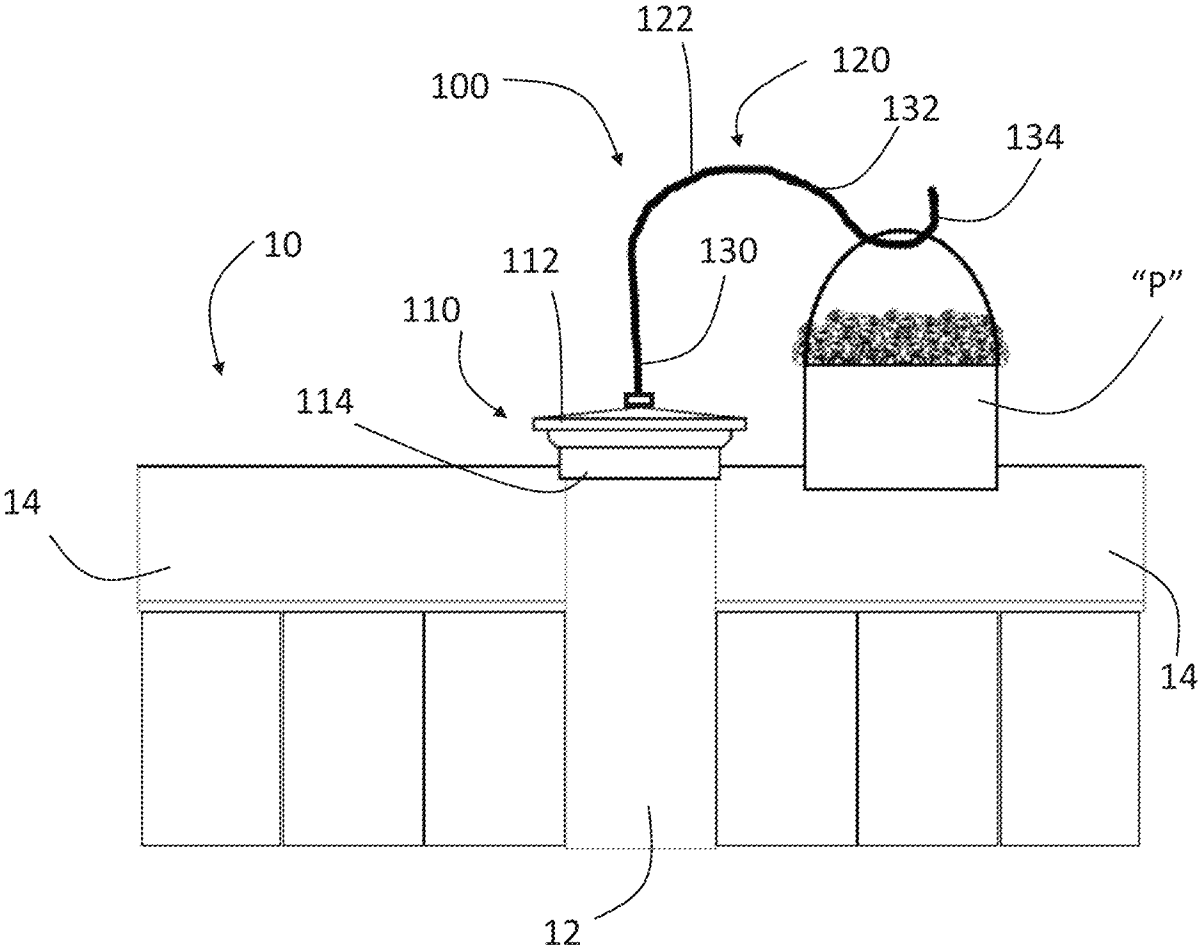
FIG. 1 is a side view of a portion of a fence system including a fence post cap assembly in accordance with the present disclosure, wherein a flowerpot is shown hanging from the fence post cap assembly.
Figure 2B:
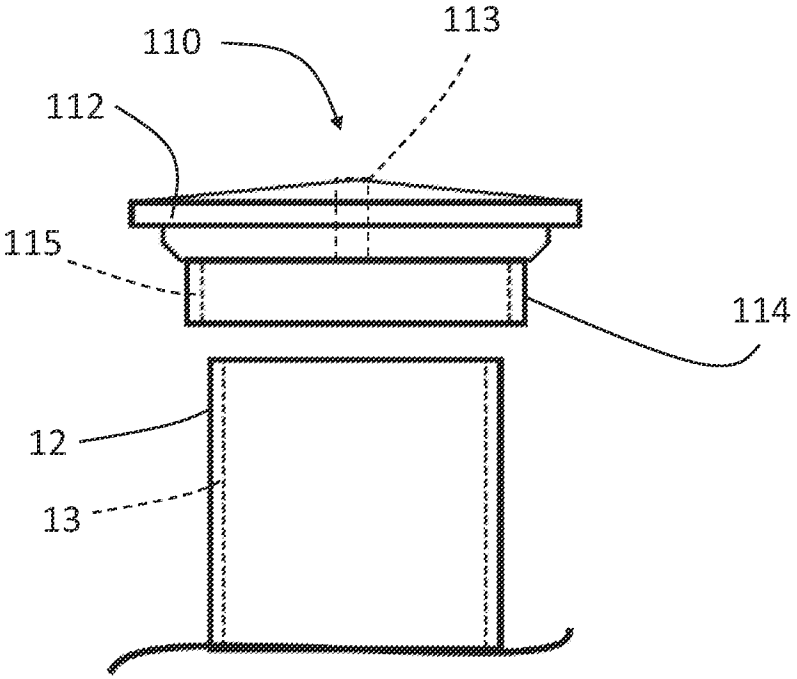
FIGS. 2A and 2B are side views of the fence post cap assembly and fence post of the fence system of FIG. 1 both with the fence post cap assembly disposed on and removed from the fence post, respectively, wherein a hanger assembly of the fence post cap assembly has been removed from the fence post cap assembly for illustration purposes.
Figure 2A:
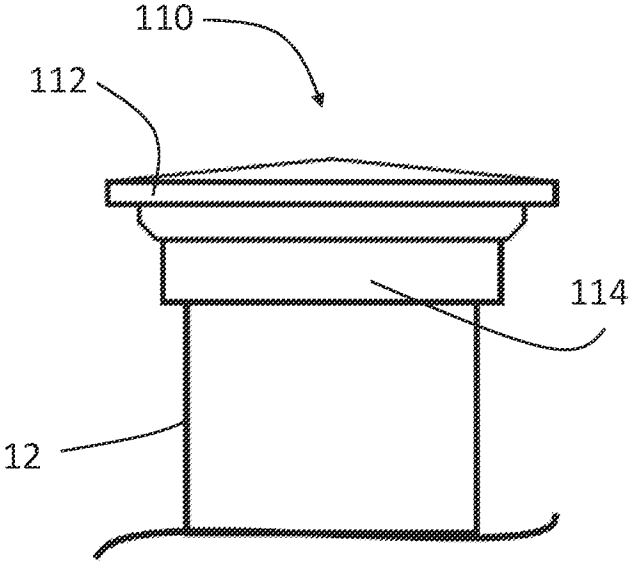

Turning to FIG. 1, a fence post cap assembly 100 provided in accordance with the present disclosure is shown in use as part of a fence system 10. Fence post cap assembly 100 includes an integrated hanger assembly 120 for supporting a hanging device, e.g., a flowerpot "P," thereby enabling the flowerpot "P" to be hung from fence system 10 when fence post cap 100 is mounted on a fence post 12 of fence system 10. For the purposes herein, fence system 10 is generally described.

Fence system 10 includes a plurality of fence posts 12 (only one fence post 12 is shown in FIG. 1) and a plurality of fence panels 14. Each fence panel 14 extends between and is supported by a pair of fence posts 12, although fence posts 12 may also support gates and/or other fence structures therebetween and/or may define end posts supporting only one fence panel 14 or other fence structure. Fence panels 14 may extend substantially coplanar relative to one another or may be disposed at angles relative to one another, e.g., about 90 degrees or at any other suitable angle. Thus, different numbers and positions of fence posts 12 and fence panels 14 enables fence system 10 to be configured in a wide variety of ways depending upon the particular purpose.

Fence posts 12 and fence panels 14 may be formed from any suitable material(s), e.g., PVC, vinyl, composite materials, metal, etc. Fence panels 14 may define any suitable length, e.g., 6 feet, 8 feet, or 10 feet, and/or any suitable style. Each fence post 12 defines a generally square transverse cross-sectional configuration of an industry standard cross-sectional size, e.g., 4×4 inches or 5×5 inches, and has a hollow interior 13 also defining a generally square transverse cross-sectional configuration. A fence post cap assembly 100 is configured for engagement about each fence post 12 to enclose the hollow interior 13 thereof. Each fence post cap assembly 100 includes a cap body 110 having any suitable design depending upon the desired aesthetic detail of fence system 10. For example, cap body 110 may define a peaked roof (e.g., as shown), a flat roof, a cylindrical top, a spear-shaped top, or any other suitable configuration and, in aspects, may alternatively or additionally include outer peripheral details such as notches, chamfers, ledges, etc.

Referring also to FIGA. 2A and 2B, fence post cap assembly 100 includes, as noted above, a cap body 110 and a hanger assembly 120 (FIG. 1) that is integrated with cap body 110. Cap body 110 defines a head 112 and a neck 114 extending from head 112. Head 112 defines an aperture 113 providing access to a hollow interior of head 112 or at least a lumen defined through head 112. Neck 114 defines a generally square transverse cross-sectional configuration and an at least partially hollow interior 115 (likewise defining a generally square transverse cross-sectional configuration) having internal dimensions substantially equal to or slightly (e.g., equal to or less than 10%) larger than the external dimensions of fence post 12 such that neck 114 can be fit over the free upper end of fence post 12 with a portion of the free upper end of fence post 12 received within hollow interior 115 of neck 114. The fitting of neck 114 over the free upper end of fence post 12 may be a friction-fit or substantial press-fit such that cap body 110 is substantially maintained in position about the free upper end of fence post 12 once fit thereon. In aspects, cap body 110 may be further retained in position about the free upper end of fence post 12 via an adhesive, fastener (e.g., one or more screws), or other suitable securement mechanism. Hollow interior 115 of neck 114 is disposed in communication with the hollow interior or lumen of head 112 and, thus, with the aperture 113 defined through head 112.

Figure 3:
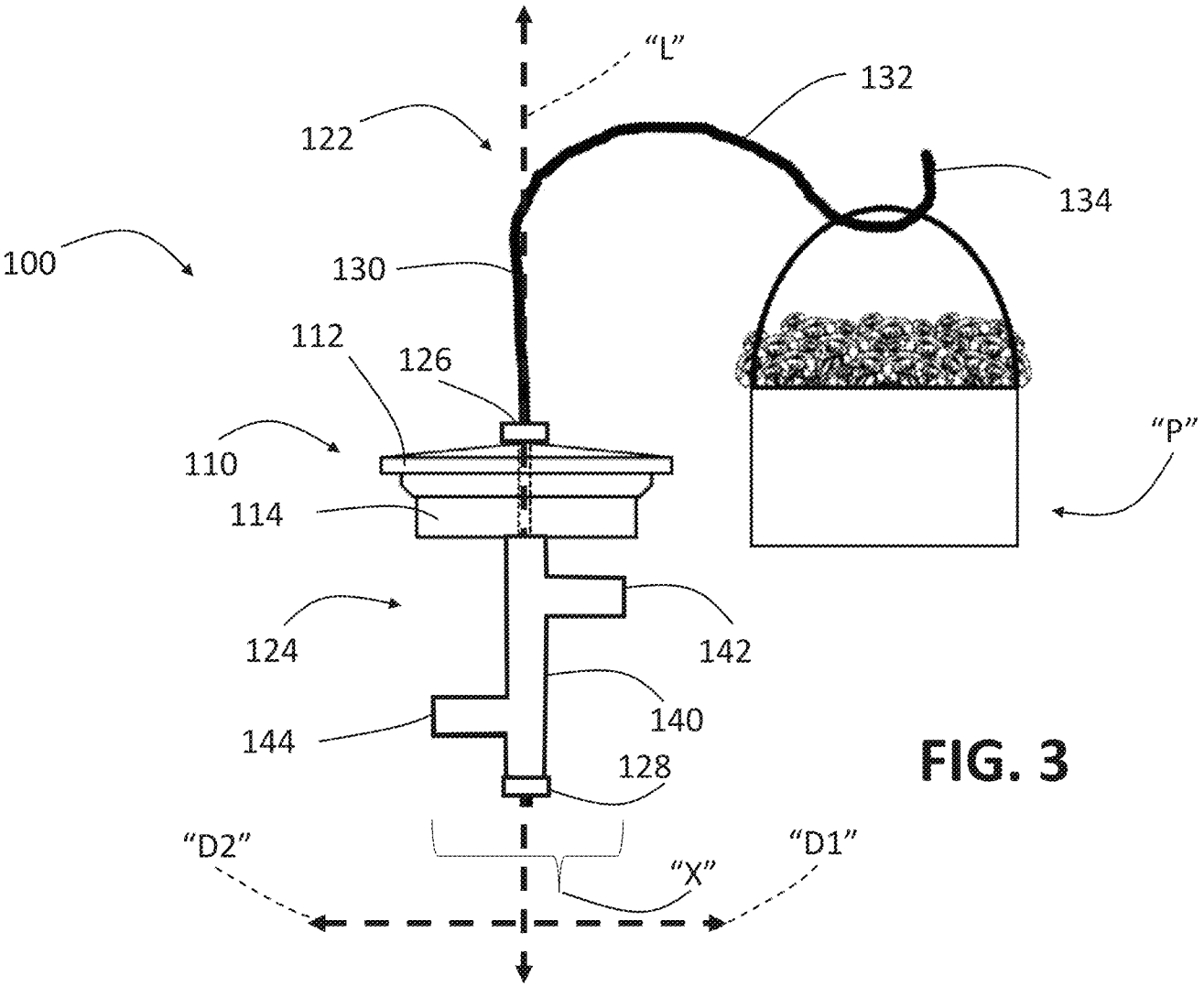
FIG. 3 is a side view of the fence post cap assembly of FIG. 1.
Figure 4:
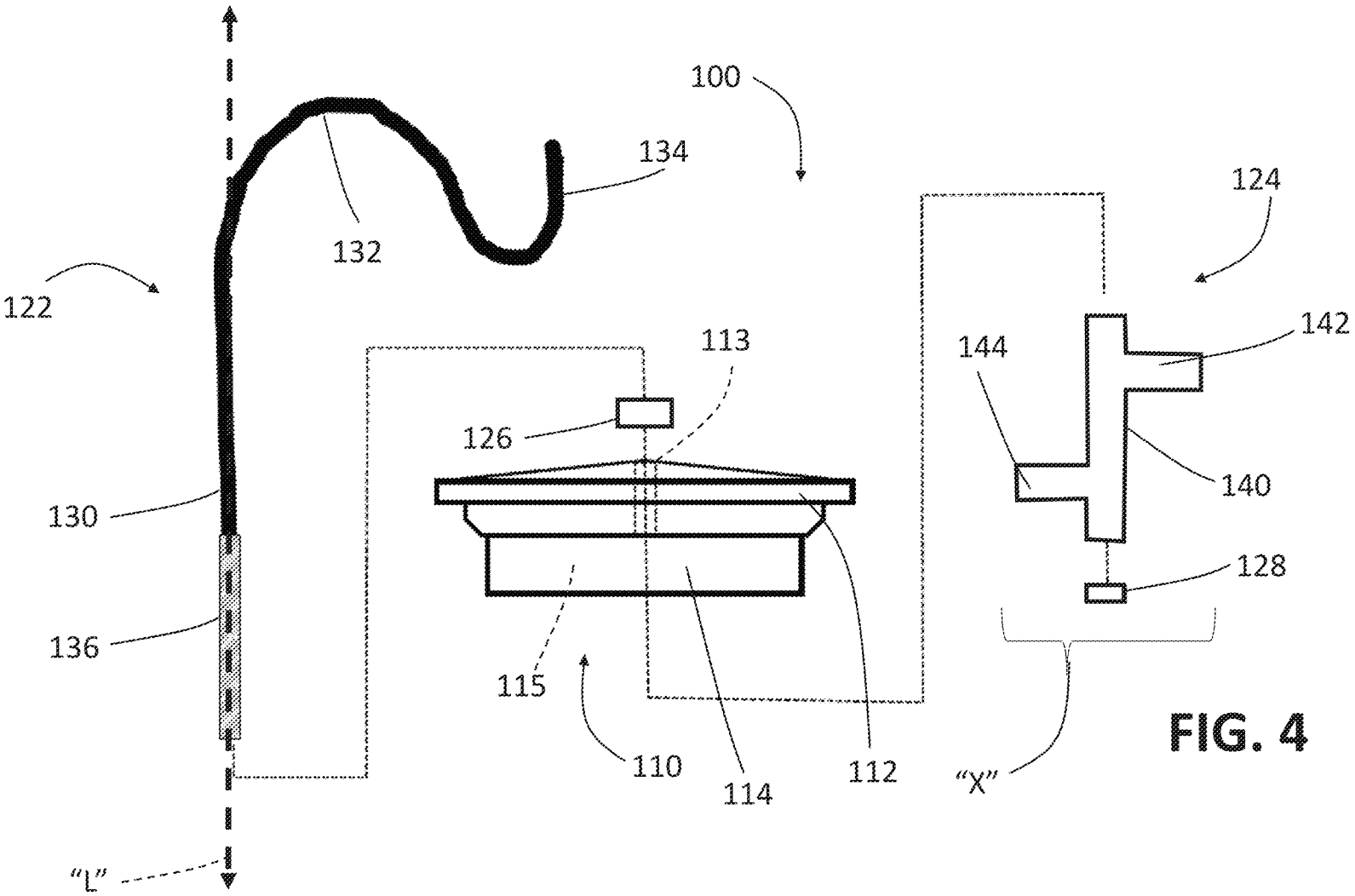
FIG. 4 is an exploded, side view of the fence post cap assembly of FIG. 1.
Figure 5:
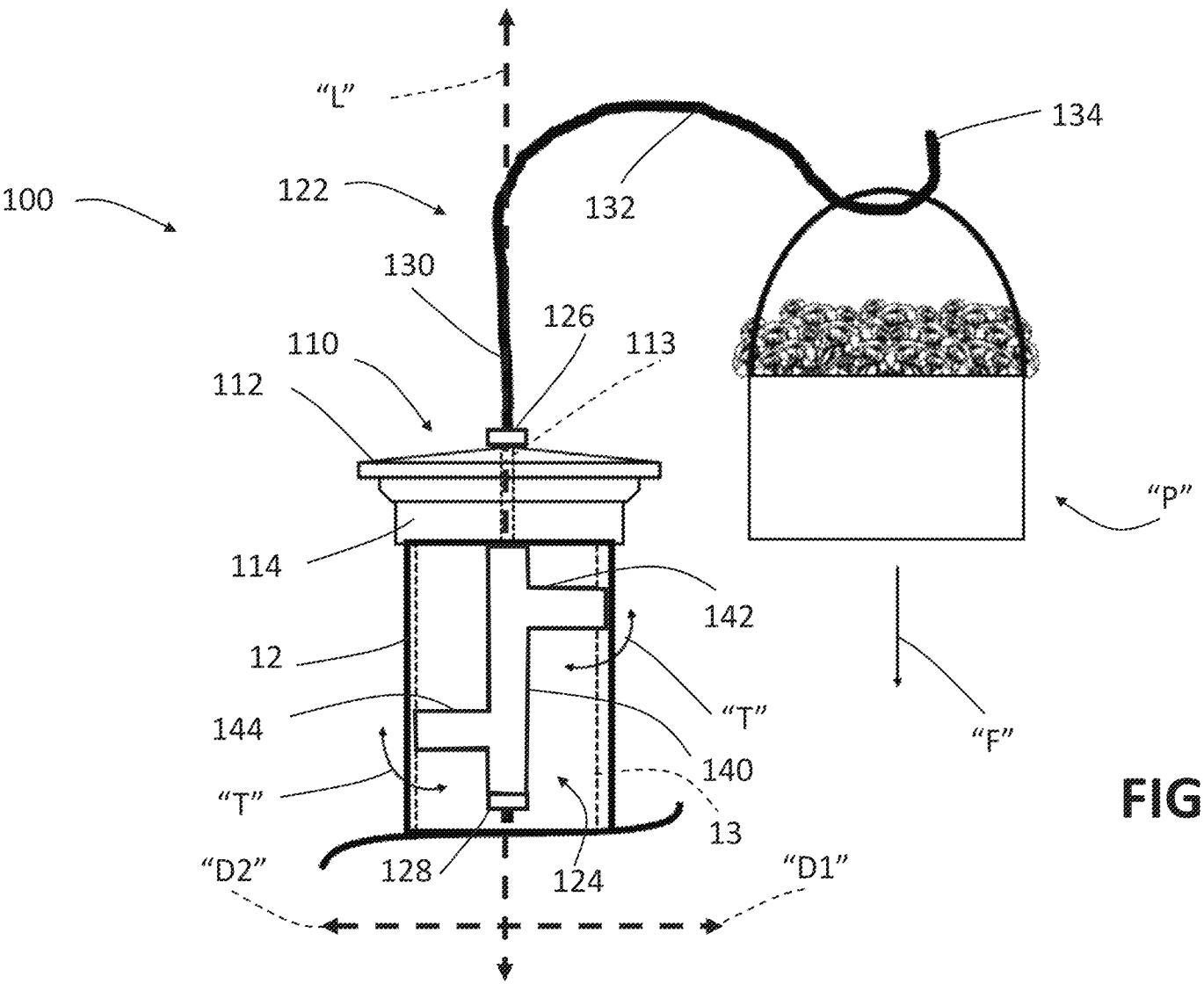
FIG. 5 is a side, partial cross-sectional view of the fence post and fence post cap assembly of FIG. 1 including a flowerpot hanging from the fence post cap assembly.

Turning to FIGS. 3-5, hanger assembly 120 includes a hanger 122, a stabilization body 124, and first and second retention nuts 126, 128, although in aspects first and/or second retention nuts 126, 128 may be replaced or eliminated. Hanger 122 may be formed from a metal rod, a metal plate, or in any other suitable configuration from any other suitable material or materials. Hanger 122 includes a support end portion 130 and a free end portion 132. Support end portion 130 defines a substantially linear configuration while free end portion 132 defines an arcuate configuration having a free hanger end 134, e.g., a hook-shaped end, a looped end, etc., configured to engage a hanging device such as, for example, flowerpot "P," a planter, lighting, decorations, etc. to thereby suspend the hanging device from hanger 122. More specifically, the arcuate free end portion 132 of hanger 122 offsets free hanger end 134 of hanger 122 from the substantially linear support end portion 130 of hanger 122 to thereby provide suitable clearance for the hanging device to be hung from free hanger end 134 of hanger 122. Thus, the substantially linear support end portion 130 defines a longitudinal axis "L" and free end portion 132 extends from longitudinal axis "L" to free hanger end 134 in a first direction "D1."

Support end portion 130 of hanger 122 extends through aperture 113 of head 112 of cap body 110 and hollow interior of neck 114 of cap body 110. In aspects, aperture 113 of head 112 of cap body 110 is substantially centered within cap body 110 such that support end portion 130 of hanger 122 is substantially centered relative to cap body 110.

Support end portion 130 of hanger 122 further extends from hollow interior 115 of neck 114 through stabilization body 124. In aspects, first and second retention nuts 126, 128 are secured about support end portion 130 of hanger 122 in spaced-apart relation relative to one another with cap body 110 and stabilization body 124 disposed therebetween to substantially fix support end portion 130 of hanger 122, cap body 110, and stabilization body 124 relative to one another. Retention nuts 126, 128 may be configured for threaded engagement about a threaded section 136 of support end portion 130 of hanger 122 or may be secured thereto in any other suitable manner.

Continuing with reference to FIGS. 3-5, stabilization body 124 may be formed from PVC or any other suitable material and includes a central support 140 and first and second support arms 142, 144 extending in opposite directions from central support 140. Central support 140 of stabilization body 124 is configured to receive support end portion 130 of hanger 122 therethrough in substantially coaxial relation relative thereto when support end portion 130 of hanger 122 is engaged with stabilization body 124. First support arm 142 extends substantially perpendicularly from central support 140 and, thus, longitudinal axis "L" of support end portion 130 of hanger 122 in the first direction "D1" (thus, in the same direction "D1" as free end portion 132 of hanger 122 extends from longitudinal axis "L"), while second support arm 144 extends substantially perpendicularly from central support 140 and, thus, longitudinal axis "L" of support end portion 130 of hanger 122 in a second direction "D2" substantially opposite the first direction "D1" (thus, substantially opposite the direction "D1" free end portion 132 of hanger 122 extends from longitudinal axis "L"). In aspects, first and second support arms 142, 144 are longitudinally spaced along central support 140 such that first support arm 142 is positioned closer to free end portion 132 of hanger 122 as compared to second support arm 144. This configuration enables support arms 142, 144 to better counterbalance one another and hanger 122, as detailed below. A distance "X" between the free ends of first and second support arms 142, 144 is substantially equal to or slightly (e.g., equal to or less than 10%) smaller than an internal width dimension of hollow interior 13 of fence post 12. That is, the distance "X" may be substantially equal to or slightly less than 4 inches, 5 inches, or other suitable post dimension. Although central support 140 and arms 142, 144 are illustrated as generally cylindrical structures, the present disclosure is not limited thereto as any suitable central support 140 having opposing end portions in the first and second directions "D1," "D2," respectively, may be utilized to enable stabilization body 124 to provide support and stabilization to hanger 122, as detailed below.

Continuing with reference to FIG. 5, in order to install fence post cap assembly 100 on the free upper end of fence post 12, fence post cap assembly 100 is moved towards the free upper end of fence post 12 led by stabilization body 124 such that stabilization body 124 is inserted through the free upper end of fence post 12 into hollow interior 13 thereof with first support arm 142 oriented in the direction where it is desired for the hanging device, e.g., flowerpot "P," to hang from hanger 122. For example, fence post cap assembly 100 may be oriented such that free end portion 132 of hanger 122 extends substantially perpendicularly relative to the panels 14 (FIG. 1) of fence system 10 or may be oriented such that free end portion 132 of hanger 122 extends substantially coplanar relative to the panels 14 (FIG. 1) of fence system 10. Other configurations are also contemplated. Because first support arm 142 extends in the same direction as free end portion 132 of hanger 122, stabilization body 124 is inserted through the free upper end of fence post 12 into hollow interior 13 such that first support arm 142 is oriented in the direction from which free end portion 132 of hanger 122 is to extend.

As noted above, the distance "X" between the free ends of first and second support arms 142, 144 of stabilization body 124 is substantially equal to or slightly smaller than the internal width dimension of hollow interior 13 of fence post 12. Thus, as stabilization body 124 is inserted through the free upper end of fence post 12 into hollow interior 13, stabilization body 124 is substantially inhibited from tilting "T" in directions "D1" or "D2" (towards or away from free end portion 132 of hanger 122, respectively) within hollow interior 13 of fence post 12 and, thus, fence post cap assembly 100 is inhibited from such tilting "T."

During installation, fence post cap assembly 100 is moved towards the free upper end of fence post 12 such that stabilization body 124 is inserted into the hollow interior 13 of fence post 12, as noted above, and until neck 114 of cap body 110 of fence post cap assembly 100 is fit about the free upper end of fence post 12 with a portion of the free upper end of fence post 12 received within hollow interior 115 of neck 114. If required, further securement may be achieved, e.g., via adhesives, fasteners, etc.

Once fence post cap assembly 100 is engaged with fence post 12 as detailed above, a hanging device, e.g., flowerpot "P," may be hung from free hanger end 134 at free end portion 132 of hanger 122. Although the hanging device exerts a downward force "F" that is off center relative to longitudinal axis "L" of support end portion 130 of hanger 122, thus exerting a force to tilt "T" fence post cap assembly 100 off-axis, the substantial retention of stabilization body 124 within hollow interior 13 of fence post 12, e.g., via the engagement of first and second arms 142, 144 with internal walls of fence post 12, counteracts this force and provides sufficient support to inhibit substantial tilting of hanger 122. In aspects, fence post cap assembly 100 is configured to support, without substantial tilting, a hanging device of at least 10 lbs.; in other aspects, of at least 15 lbs.; and, in yet other aspects, of at least 20 lbs.

Figure 6:
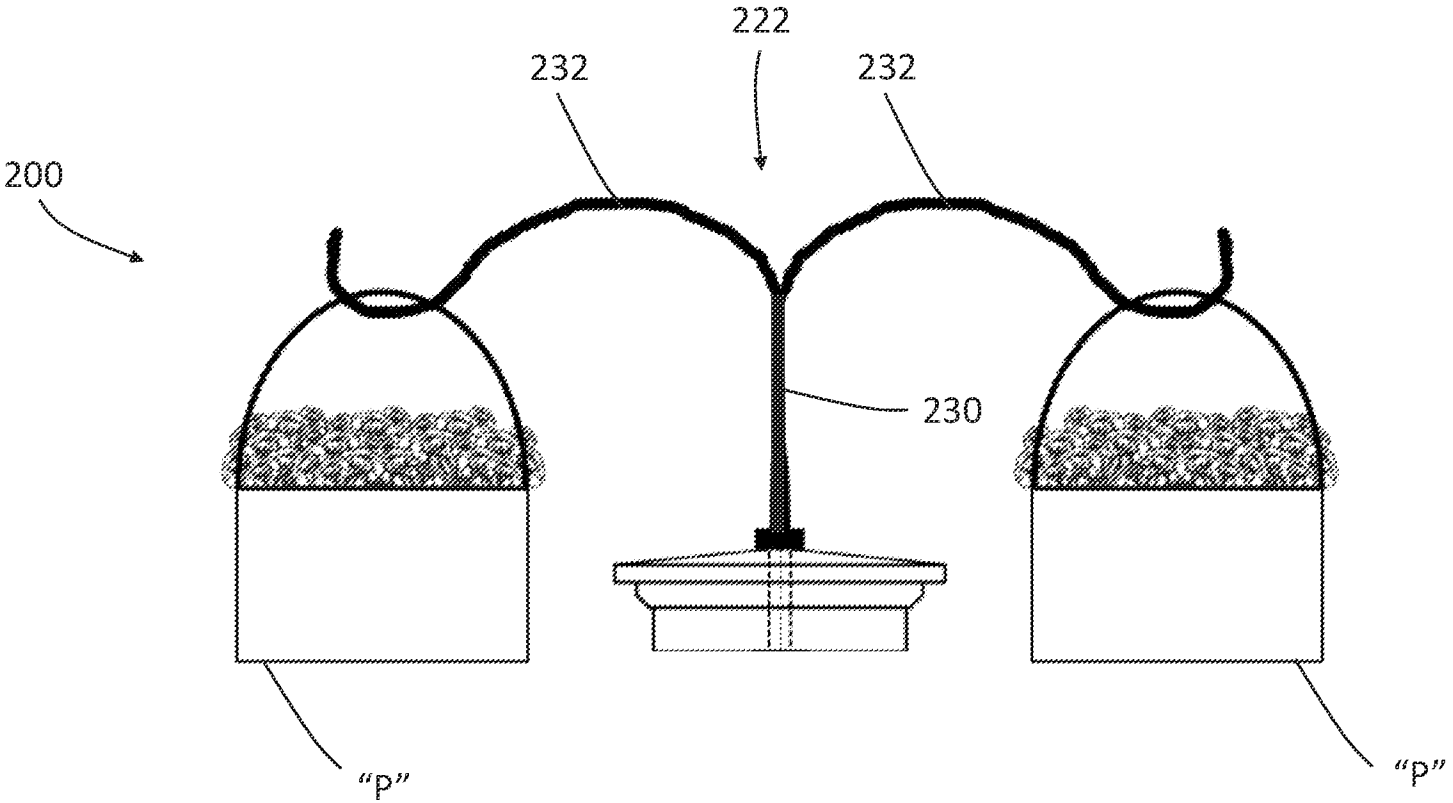
FIG. 6 is a side view of a portion of another fence post cap assembly provided in accordance with the present disclosure.

Turning to FIG. 6, another fence post cap assembly 200 provided in accordance with the present disclosure is shown wherein hanger 222 includes at least two free end portions 232 extending in different directions from a common support end portion 230 or a pair of support end portion 230 connected to one another along at least portions of the lengths thereof. As shown, hanger 222 includes two free end portions 232 oriented in first and second different directions approximately 180 degrees apart from one another (thus enabling, for example, hanging of hanging devices such as flowerpots "P" on either side of a fence or on either side of a fence post along the fence). However, in aspects, more than two free end portions 232 may be provided and/or the angle(s) defined therebetween may be varied; for example, four (4) free end portions 232 may be provided and oriented approximately 90 degrees relative to one another. In aspects where multiple free end portions 232 are provided at angles of approximately 90 degrees relative to one another, the stabilization body may include two pairs of support arms oriented approximately 90 degrees relative to one another to provide stabilization in two perpendicular directions. Other configurations are also contemplated. Fence post cap assembly 200 may otherwise be similar to and include any of the features of fence post cap assembly 100 (FIGS. 3-5) as detailed above.

While several aspects of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular configurations. Those skilled in the art will envision other modifications within the scope and spirit of the claims appended hereto.

What is claimed is:

1. A fence post cap assembly, comprising:

a cap body including a head and a neck extending from the head, the neck defining a hollow interior, the head defining an aperture in communication with the hollow interior of the neck;

a hanger having a support end portion and at least one free end portion, the support end portion defining a longitudinal axis and extending through the aperture of the head of the cap body, the at least one free end portion of the hanger disposed above the cap body and extending from the longitudinal axis in a first direction and configured to receive a hanging device for hanging the hanging device from the hanger at a position offset from the longitudinal axis in the first direction; and a unitary, one-piece stabilization body engaged to the support end portion of the hanger below the cap body, the stabilization body including a central support extending along the longitudinal axis, a first arm disposed at a first end portion of the central support and extending from the longitudinal axis in the first direction, and a second arm disposed at a second end portion of the central support and extending from the longitudinal axis in a second direction opposite the first direction, the first and second arms longitudinally offset along the longitudinal axis and extending from the first and second end portions, respectively, such that the first arm is positioned closer to the cap body along the longitudinal axis compared to the second arm, wherein the fence post cap assembly is configured to engage a free end of a fence post with the stabilization body disposed within an interior of the fence post and the hollow interior of the neck of the cap body receiving the free end of the fence post, and wherein the first and second arms of the stabilization body are configured to contact walls in the interior of the fence post to stabilize the hanger.

2. The fence post cap assembly according to claim 1, wherein the at least one free end portion of the hanger includes a hook disposed at a free end thereof, the hook configured to receive the hanging device.

3. The fence post cap assembly according to claim 1, wherein the at least one free end portion of the hanger defines an arcuate configuration extending from the longitudinal axis in the first direction.

4. The fence post cap assembly according to claim 1, further comprising at least one retention nut configured to secure the hanger to at least one of the cap body or the stabilization body.

5. The fence post cap assembly according to claim 4, wherein the at least one retention nut includes first and second retention nuts securing the hanger, the cap body, and the stabilization body therebetween.

6. The fence post cap assembly according to claim 1, wherein the hanger is a metal rod.

7. The fence post cap assembly according to claim 1, wherein the hollow interior of the neck of the cap body defines a square cross-sectional configuration.

8. The fence post cap assembly according to claim 7, wherein the square cross-sectional configuration is configured to receive a fence post having a square cross-sectional configuration.

9. The fence post cap assembly according to claim 7, wherein the square cross-sectional configuration is 4 inches by 4 inches.

10. The fence post cap assembly according to claim 7, wherein the square cross-sectional configuration is 5 inches by 5 inches.

11. A fence system, comprising:

the fence post cap assembly according to claim 1; and a fence including the fence post and at least one fence panel connected to the fence post.

12. The fence system according to claim 11, wherein the first and second directions are substantially coplanar relative to the at least one fence panel.

13. The fence system according to claim 11, wherein the first and second directions are substantially perpendicular relative to the at least one fence panel.

14. The fence system according to claim 11, wherein the at least one fence panel includes first and second fence panels connected to the fence post and extending from the fence post in different directions.

* * * * *